US009791247B2

(12) United States Patent
Parker

(10) Patent No.: US 9,791,247 B2
(45) Date of Patent: Oct. 17, 2017

(54) FIRING DEVICE

(71) Applicant: CGS Group. LLC, Artesia, NM (US)

(72) Inventor: Joshua J. Parker, Artesia, NM (US)

(73) Assignee: CGS Group LLC, Artesia, NM (US)

( * ) Notice: Subject to any disclaimer, the term of this patent is extended or adjusted under 35 U.S.C. 154(b) by 0 days.

(21) Appl. No.: 15/152,507

(22) Filed: May 11, 2016

(65) Prior Publication Data

US 2016/0370157 A1 Dec. 22, 2016

Related U.S. Application Data

(60) Provisional application No. 62/160,040, filed on May 12, 2015.

(51) Int. Cl.

| | |
|---|---|
| ***F42B 3/10*** | (2006.01) |
| ***C06C 5/06*** | (2006.01) |
| ***F42C 7/12*** | (2006.01) |
| ***F42D 1/04*** | (2006.01) |
| *F41A 17/46* | (2006.01) |

(52) U.S. Cl.

CPC ..... *F42B 3/10* (2013.01); *C06C 5/06* (2013.01); *F42C 7/12* (2013.01); *F42D 1/04* (2013.01); *F41A 17/46* (2013.01)

(58) Field of Classification Search

CPC ..... F42B 3/10; C06C 5/06; F42C 7/12; F42D 1/04; F41A 17/46

USPC ..... 102/275.11

See application file for complete search history.

(56) References Cited

U.S. PATENT DOCUMENTS

| | | | | |
|---|---|---|---|---|
| 2,947,220 | A | 8/1960 | Laager | |
| 3,214,857 | A * | 11/1965 | Tyrone | G08B 15/00 116/86 |
| 3,590,739 | A * | 7/1971 | Persson | F42D 1/04 102/275.5 |
| 3,641,868 | A | 2/1972 | Reed | |
| 3,678,800 | A | 7/1972 | Seidel et al. | |
| 3,696,706 | A | 10/1972 | Seidel et al. | |
| 3,750,529 | A | 8/1973 | Reed et al. | |
| 3,992,999 | A * | 11/1976 | Chevrier | F42C 5/02 102/230 |

(Continued)

OTHER PUBLICATIONS

International Search Report for the International Application No. PCT/US2016/031946 dated Aug. 12, 2016, 2 pages.

(Continued)

*Primary Examiner* — Joshua Freeman

(74) *Attorney, Agent, or Firm* — Lightfoot & Alford PLLC

(57) ABSTRACT

A shock-tube firing device has an enclosure and at least two primer-ignition devices translatably carried within the enclosure. A threaded bore for each primer-ignition device is adjacent a forward end of the associated primer-ignition device and configured to receive a threaded shock-tube adapter. A trigger assembly is carried by the enclosure and comprises an actuation portion and a carrier portion, the actuation portion causing rearward motion of the carrier portion. A biasing element for each primer-ignition device causes forward motion of the associated primer-ignition device. A sear for each primer-ignition device causes compression of the associated biasing element during movement of the actuation portion, thereby compressing the biasing elements for causing forward motion of the primer-ignition devices.

20 Claims, 17 Drawing Sheets

(56) References Cited

U.S. PATENT DOCUMENTS

| | | | | | |
|---|---|---|---|---|---|
| 4,004,488 | A * | 1/1977 | Williams | F42C 7/12 | 102/261 |
| 4,008,666 | A * | 2/1977 | Beermann | F42C 7/12 | 102/261 |
| 4,207,795 | A * | 6/1980 | Reed | F41A 19/21 | 89/1.813 |
| 4,220,087 | A * | 9/1980 | Posson | C06C 5/04 | 102/275.6 |
| 4,381,711 | A * | 5/1983 | Lawrence | F42C 7/12 | 102/200 |
| 4,759,291 | A | 7/1988 | Barker et al. | | |
| 4,962,708 | A * | 10/1990 | Snyder | F42D 1/045 | 102/275.11 |
| 5,012,741 | A | 5/1991 | Peebles et al. | | |
| 5,365,851 | A | 11/1994 | Shaw | | |
| 6,272,996 | B1 | 8/2001 | O'Brien et al. | | |
| 6,581,519 | B1 | 6/2003 | Adams | | |
| 6,951,070 | B2 | 10/2005 | Fleischhauer et al. | | |
| 7,069,862 | B2 | 7/2006 | Bassett | | |
| 7,188,566 | B2 | 3/2007 | Gladden | | |
| 7,490,554 | B2 | 2/2009 | Lynch et al. | | |
| 7,665,401 | B2 | 2/2010 | Ballantine et al. | | |
| 7,765,932 | B2 | 8/2010 | Allman | | |
| 8,234,978 | B1 | 8/2012 | Bond et al. | | |
| 9,021,956 | B1 * | 5/2015 | Chamberlain | F42D 1/04 | 102/275.7 |
| 2005/0126418 | A1 | 6/2005 | Lynch et al. | | |
| 2005/0257675 | A1 * | 11/2005 | Bassett | E21B 7/007 | 89/1.14 |
| 2007/0266881 | A1 * | 11/2007 | Allman | C06C 5/06 | 102/275.11 |
| 2008/0245253 | A1 | 10/2008 | Lynch et al. | | |
| 2008/0282923 | A1 | 11/2008 | Lynch et al. | | |

OTHER PUBLICATIONS

Written Opinion for the International Application No. PCT/US2016/031946 dated Aug. 12, 2016, 4 pages.

Dual Center Punch Initiator Kit; http://www.idealblasting.com/dualcenterpunchshocktubeinitiatorkit.aspx.

Dx33 10U E0D Dual Initiator; http://www.idealblasting.com/eod-dualinitiator.aspx.

E0D Dual Shock Tube Initiators; http://www.idealblasting.com/eoddualshocktube.aspx.

Royal Dual Ignitor with Detachable Block; http://www.idealblasting.com/royalnoneldualignitor.aspx.

Royal Arms Nonel Dual Igniter; http://www.idealblasting.com/royalnoneldualigniter.aspx.

Nicholas C., "Llama Pressin Double Barreled AOW", The Firearm Blog, NFA/Suppressors/Class III, Feb. 19, 2015,1 page. http://www.thefirearmblog.com/blog/2015/02/19/double-barreled-aow/.

Army Recognition, "Policske strojirny a.s. presents individual defense equipment SF1 KRAKEN and system SRNA", May 18, 2013, 1 page. http://www.armyrecognition.com/idet_2013_news_coverage_report_pictures_video/policske_strojirny_a.s._presents_individual_defense_equipment_sf1_kraken_and_system_sma_1805135.html.

* cited by examiner

FIRING DEVICE

CROSS-REFERENCE TO RELATED APPLICATIONS

This disclosure claims the benefit of the filing date of U.S. Provisional Patent Application Ser. No. 62/160,040, filed on May 12, 2015, and titled FIRING DEVICE HAVING DUAL STRIKERS, the entire content of which is hereby expressly incorporated by reference.

STATEMENT REGARDING FEDERALLY SPONSORED RESEARCH OR DEVELOPMENT

Not applicable.

BACKGROUND

Firing devices are used to initiate a detonation in one end of a shock tube. The detonation travels through the shock tube and allows for the detonation of explosives at the other end of the shock tube.

DETAILED DESCRIPTION

Figure 1:
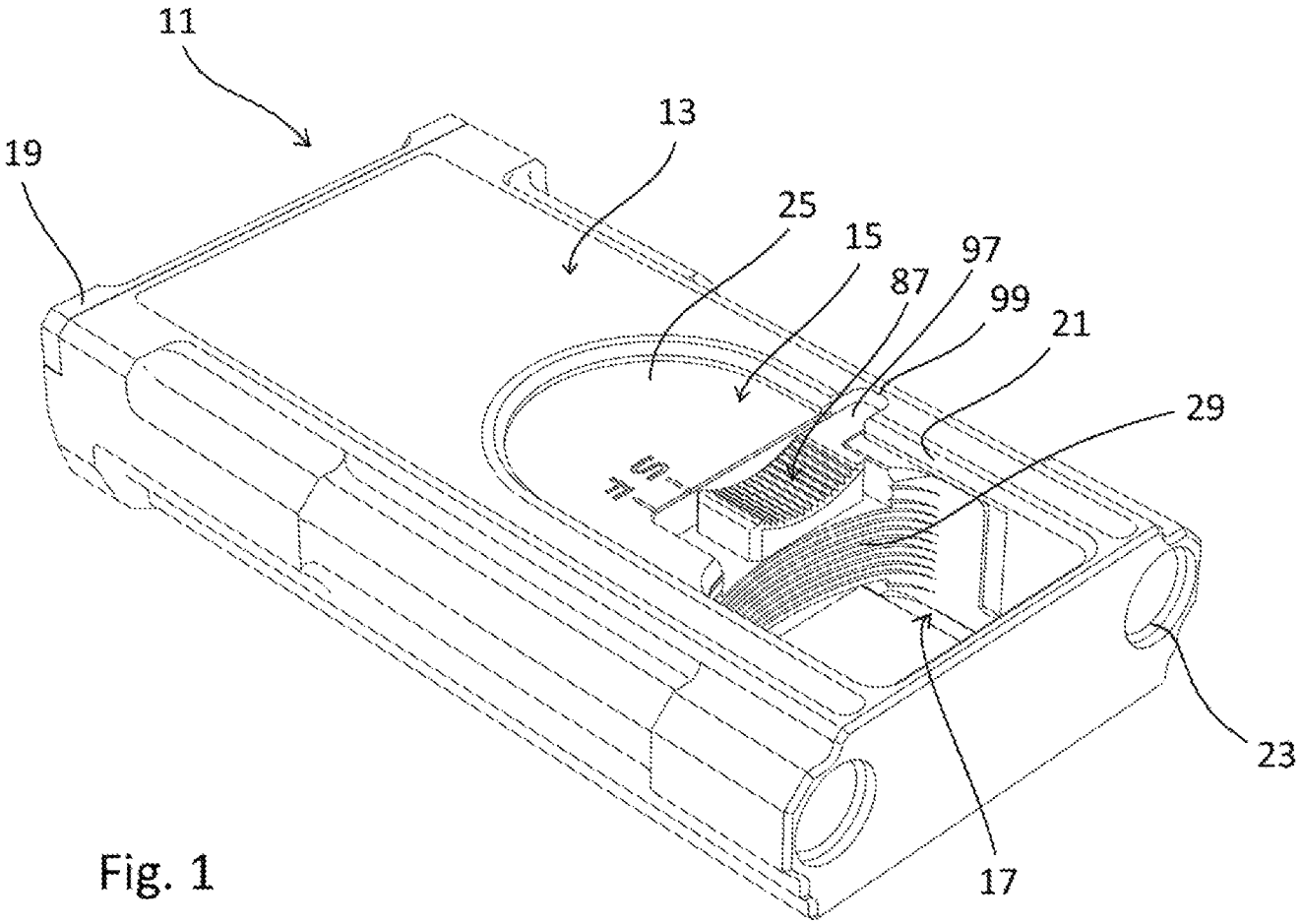
FIG. 1 is an oblique view of a firing device according to this disclosure.
Figure 2:
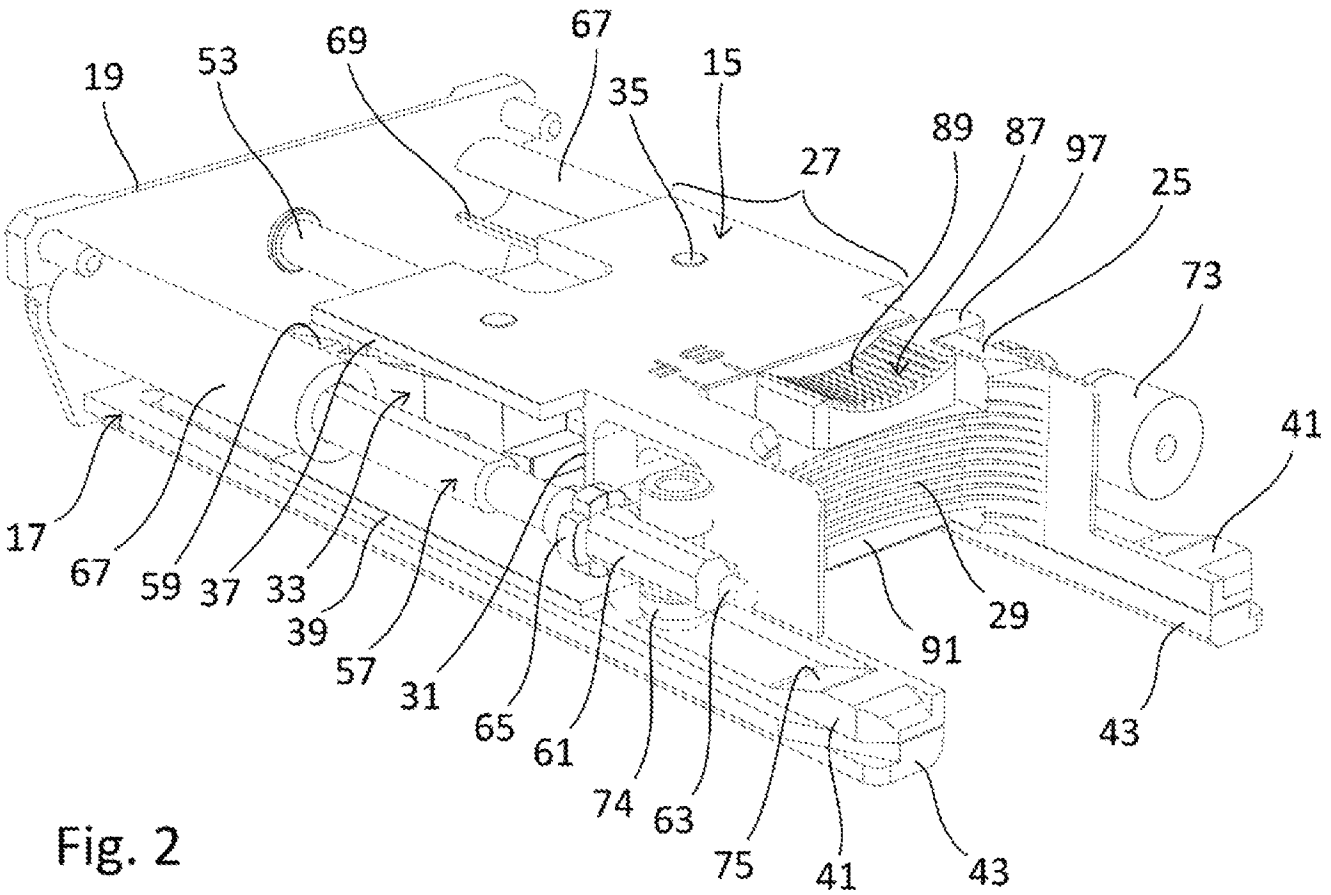
FIG. 2 is an oblique view of the firing device of FIG. 1 with a component removed for ease of viewing.
Figure 3:
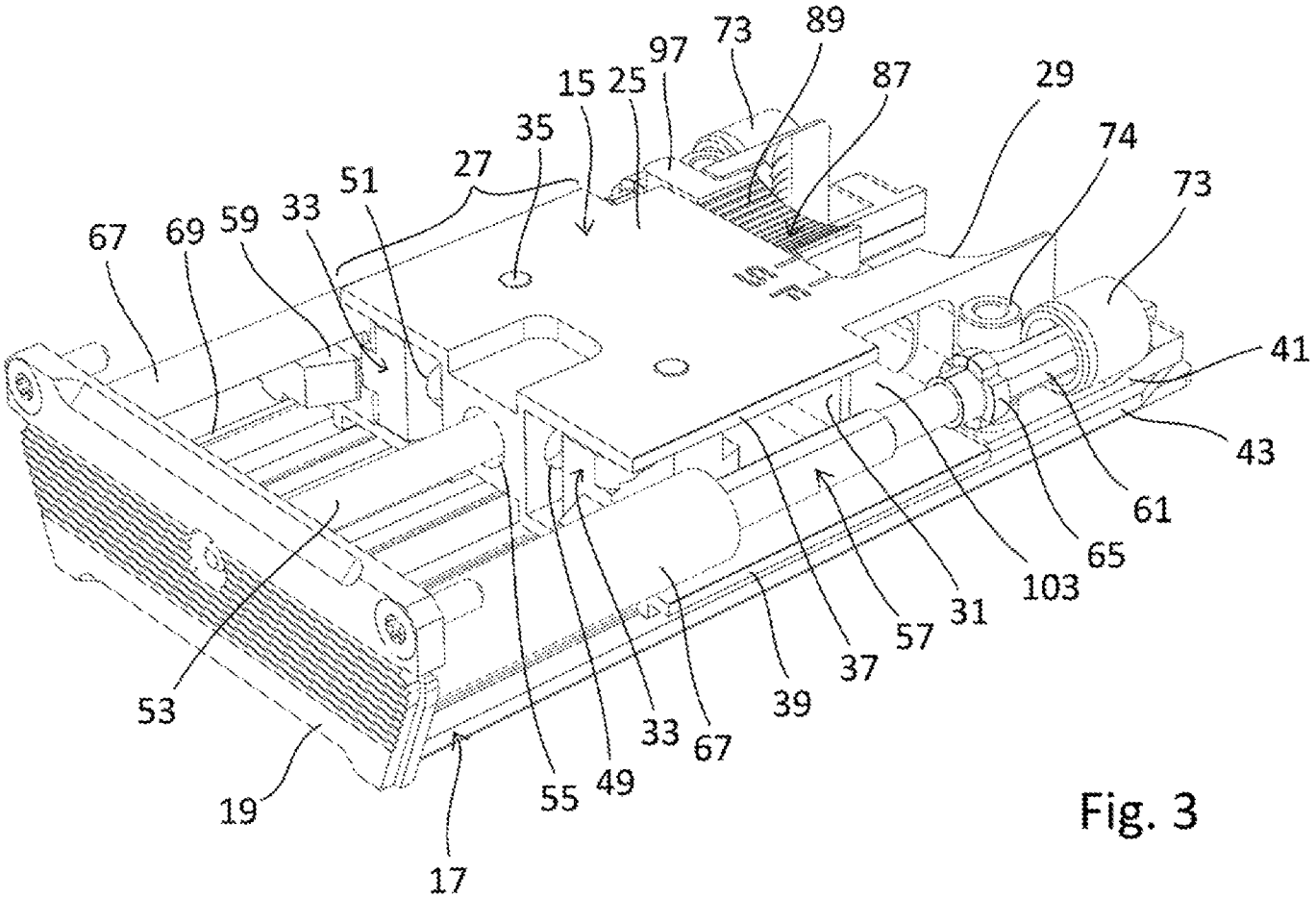
FIG. 3 is an oblique view of the firing device of FIG. 1 with a component removed for ease of viewing.
Figure 4:
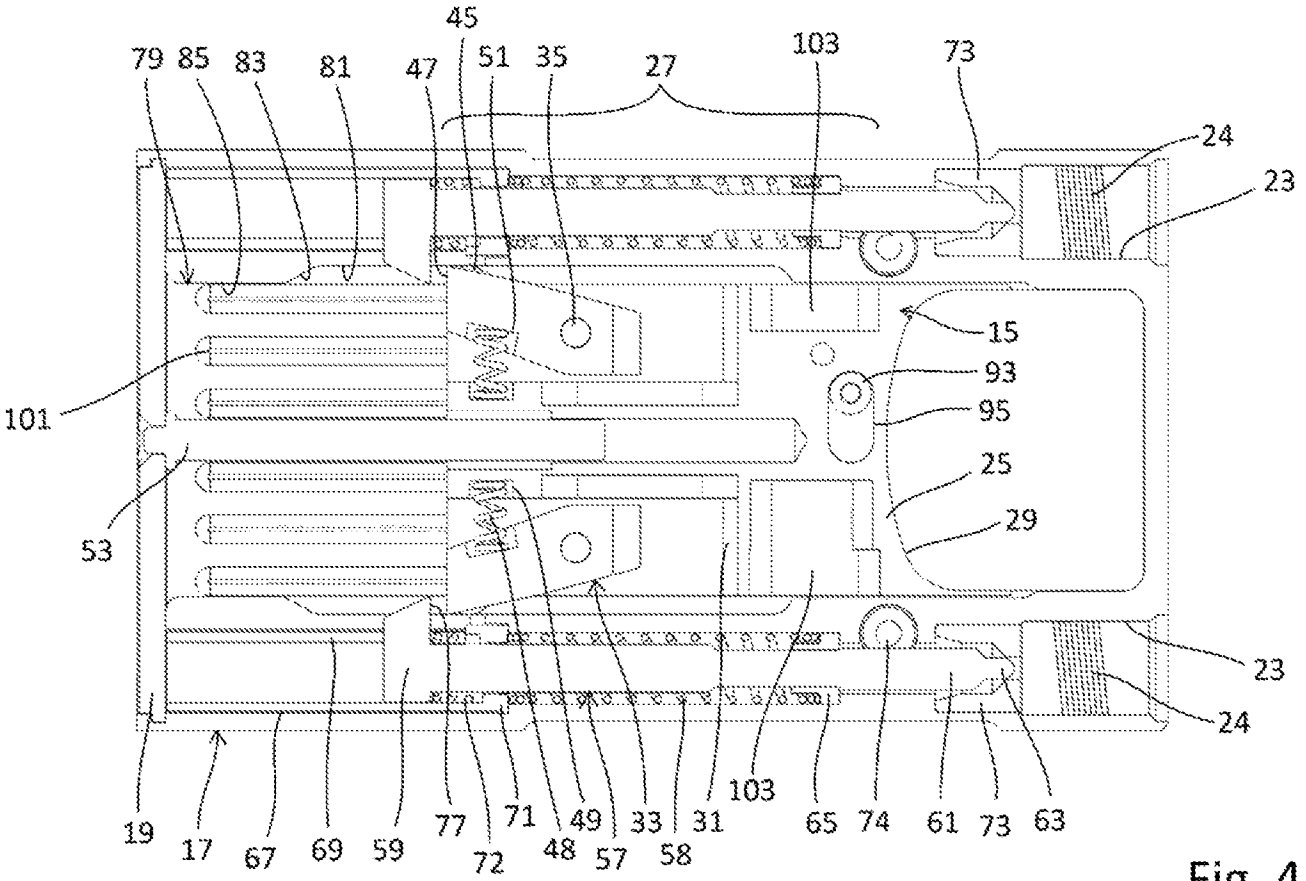
FIG. 4 is a cross-section top view of the firing device of FIG. 1 along a horizontal plane.
Figure 5:
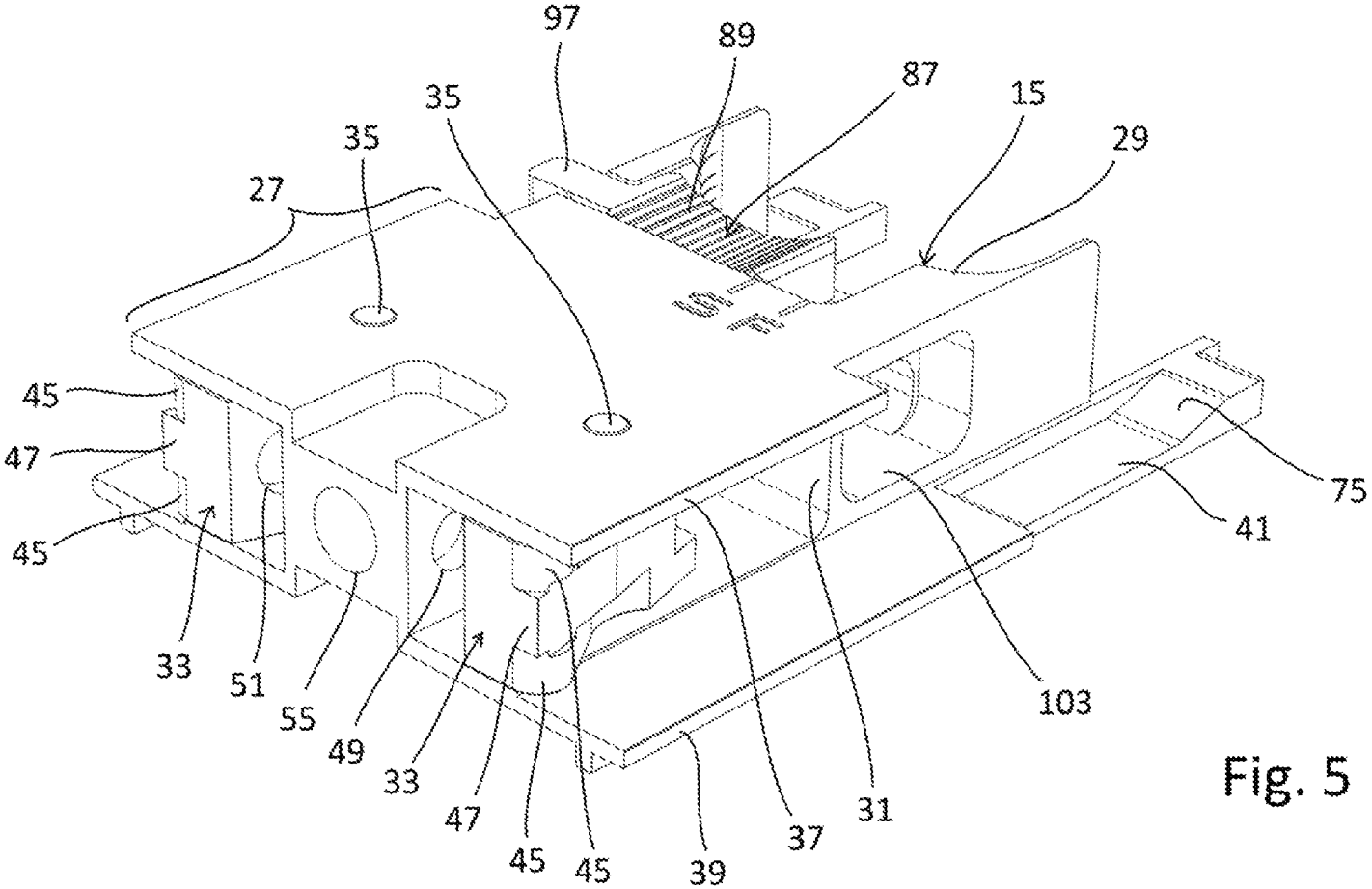
FIG. 5 is an oblique view of a trigger assembly of the firing device of FIG. 1.

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In this specification, reference may be made to the spatial relationships between various components and to the spatial orientation of various aspects of components as the devices are depicted in the attached drawings. However, as will be recognized by those skilled in the art after a complete reading of this disclosure, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

There is a need for an improved firing device having multiple primer-ignition devices, such as strikers or firing pins, for initiating detonations in shock tubes. In the preferred embodiment, at least one primer-ignition device is able to be actuated when one or more of the other primer-ignition devices are inoperable. The design includes a sear carrier that allows the primer-ignition devices to be actuated by a translatable trigger, a rotary trigger, or a lever. The design also allows for immediate restrike capability.

FIGS. 1 through 19 illustrate embodiments of firing devices according to this disclosure. In the embodiments shown, the firing devices comprise identical features on both sides of a central, vertical symmetry plane that extends longitudinally, though the devices may alternatively be constructed to have a nonsymmetrical configuration. Descriptions of features on one side of the devices apply to corresponding features on the other side of the devices. In addition, it should be noted that embodiments of the devices may be constructed to have two primer-ignition devices, as shown, or to have additional primer-ignition devices, and the primer-ignition devices may be operated by one or more triggers.

FIGS. 1 through 12 illustrate device 11 that comprises a housing 13 and a trigger assembly 15 carried within and longitudinally movable relative to housing 13. In the embodiment shown, housing 13 is generally rectangular and couples to a cover plate 17 and a rear plate 19 for creating an enclosure having an enclosed interior volume. The enclosure is preferably waterproof, but it is at least resistant to liquids or dust entering the volume. Trigger assembly 15 is slidably carried between housing 13 and cover plate 17, and housing 13 has an aperture 21 to allow a user to access trigger assembly 15 from the top of device 11. In the preferred embodiments, no part of trigger assembly 15 protrudes beyond the outer surfaces of housing 13 and cover plate 17, providing device 11 with a compact and generally snag-free outer shape.

Two parallel bores 23 are formed in a forward portion of housing 13 and allow for shock-tube inserts (shown in FIGS. 11 through 13 and described below) to be attached within bores 23. Bores 23 preferably have threads 24 for securing shock tube inserts within bores 23. In the embodiment shown, trigger assembly 15 translates relative to housing 13 along an axis parallel to the axes of bores 23.

Trigger assembly 15 comprises a forward actuation portion 25 and a rearward carrier portion 27. In the embodiment shown, actuation portion 25 and carrier portion 27 are formed as a unitary component, though portions 25, 27 may alternatively be formed as separate components. Actuation portion 25 has a forward surface 29 shaped for receiving a finger of a user, surface 29 being oriented to allow the user to move trigger assembly 15 rearward within housing 13 by applying rearward force in a pulling motion. As visible in the figures and especially in FIGS. 4 and 5, carrier portion 27 has two pockets 31, and a sear 33 is pivotally coupled to carrier 27 in each pocket 31 with vertical pins 35. Each pocket 31 has an upper plate 37 and a lower plate 39, and pins 35 extend through plates 37, 39 and sears 33, providing double-shear mounting of sears 33. Carrier portion 27 also comprises two striker-block actuator arms 41, which protrude forward from lower plate 39 on opposite sides of actuation portion 25 and are generally aligned with bores 23. Cover plate 17 has corresponding extensions 43 that are located on each side of actuation portion 25 and extend forward for covering block actuator arms 41 and sealing arms 41 within the enclosure. Each arm 41 and extension 43 is spaced from its corresponding feature so as to approximate the width of aperture 21. This allows the finger of a user to pass between arms 41 and extensions 43, allowing the user to also access surface 29 of trigger assembly 15 from the bottom of device 11.

Each sear 33 is a rigid body, and each pin 35 is located in a central portion of the corresponding sear 33. On the rearward portion of each sear 33, a pair of upper and lower curved cam surfaces 45 are separated by a central sear face 47. The rear portion of sear 33 is biased outward by a spring 48 that exerts force between spring recess 49 in an inner portion of sear pocket 31 and spring recess 51 in sear 33. Trigger assembly 15 is biased by trigger spring assembly 53 toward the forward, neutral position shown in FIGS. 1 through 4, with spring assembly 53 extending from rear plate 19 and into spring recess 55 in the rear of trigger assembly 15.

A pair of strikers 57 are located within housing 13 on each side of device 11, and each striker 57 is biased forward by a striker spring 58 toward a forward neutral position, as shown in FIGS. 1 through 4. Each striker 57 is preferably a rigid, one-piece component comprising a rear lug 59, a block engagement portion 61, and a tip 63. A two-piece spring cup 65 is assembled onto a central portion of striker 57. Strikers 57 are carried within sleeves 67, and lug 59 of each striker 57 rides within a slot 69 of sleeve 67. Each striker spring 58 biases the corresponding striker 57 forward and extends between a forward end 71 of sleeve 67 and spring cup 65. A rebound spring 72 extends between end 71 and lug 59 for biasing striker 57 rearward toward the neutral position. A cylindrical tip guide 73, preferably formed from steel and press-fit into housing 13, provides for centering of tip 63 relative to bore 23 and acts as a forward stop for striker 57 when block engagement portion 61 contacts guide 73. Guides 73 also provide for correct headspacing.

When striker 57 is moved rearward to compress striker spring 58 and then released, striker 57 moves forward enough so that tip 63 extends forward out of guide 73 and into bore 23 for striking and igniting a primer in the corresponding shock-tube insert installed in bore 23. After striking the primer, rebound spring 72 causes striker 57 to rebound a slight distance to the neutral position, wherein striker tip 63 is recessed from bore 23.

To prevent tip 63 from entering bore 23 in an unintended movement and thereby causing an unwanted ignition of a primer, a striker block 74 engages block engagement portion 61. Block 74 is capable of vertical movement relative to striker 57 and is biased downward by a spring (not shown) to a safe position, in which striker is prevented from moving forward from the neutral position enough to extend tip 63 into bore 23. Block 74 is moved upward to a firing position as striker block actuator arms 41 are moved rearward. An inclined cam surface 75 is located on a forward portion of each arm 41, and surface 75 forces block 74 upward as surface 75 passes under block 74. This moves block 74 to the firing position, wherein striker 57 is unlocked and allowed to move forward from the neutral position an amount sufficient to extend tip 63 into bore 23.

As trigger assembly 15 is moved rearward, each sear 33 engages lug 59 of the corresponding striker 57 for causing striker 57 to move rearward and compress striker spring 58. Sear face 47 contacts a lug face 77 for causing striker 57 to move rearward with trigger assembly 15. To release striker 57 during this rearward motion after striker spring 58 is sufficiently compressed, a longitudinal cam profile 79 is formed on upper and lower portions of each side of housing 13 for acting on cam surfaces 45 on the corresponding sear 33. As shown in FIGS. 4 and 7 through 9, cam profile 79 comprises an outer rail 81, a ramp 83, and an inner rail 85.

Figure 7:
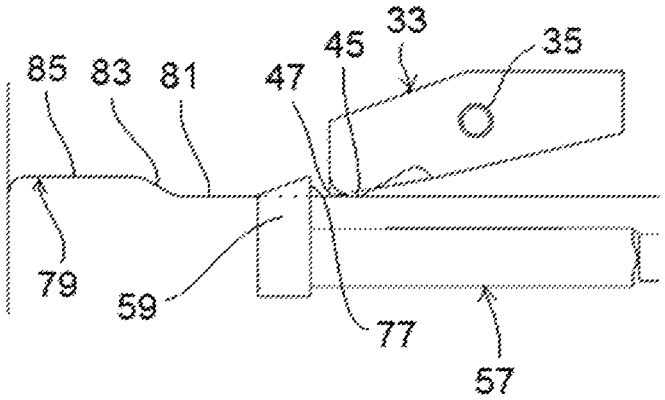
FIGS. 7 through 9 are top schematic views depicting stages of movement of a sear and striker during operation of the firing device of FIG. 1.
Figure 8:
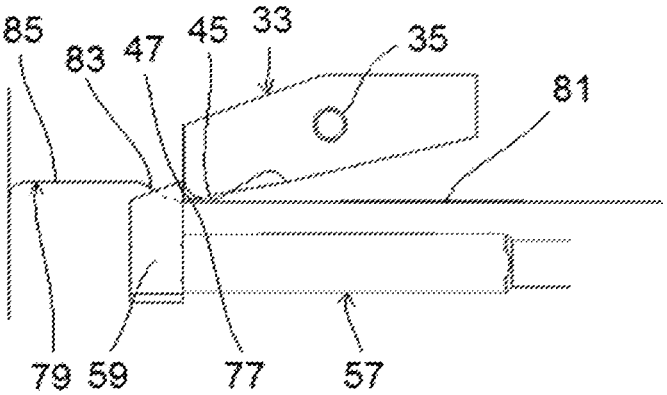
Figure 9:
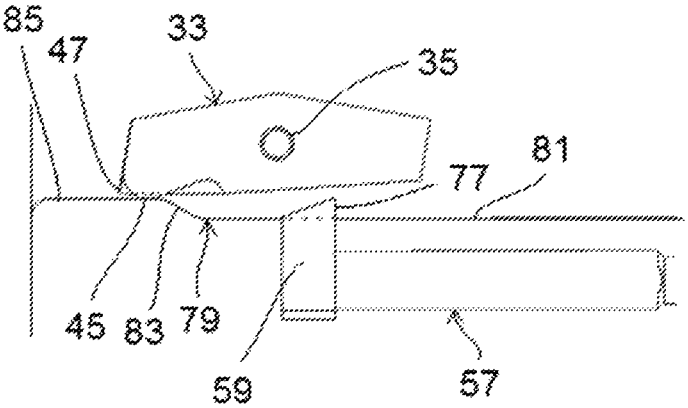

FIGS. 7 through 9 illustrate stages of the rearward motion of sear 33 and striker 57 relative to cam profile 79. In FIG. 7, sear 33 and striker 57 are in their neutral positions, with cam surfaces 45 biased against outer rail 81. This positions sear face 47 for contact with lug face 77 when sear 33 is moved rearward with trigger assembly 15. In FIG. 8, sear 33 has moved rearward, with sear face 47 contacting lug face 77 and causing striker 57 to move rearward, compressing striker spring 58. Cam surfaces 45 are located on outer rail 81 slightly forward of ramp 83, and any further rearward motion will begin to cause sear 33 to rotate about pin 35 as ramp 83 forces cam surfaces 45 inward. This rotation of sear 33 begins to move sear face 47 inward, and as sear 33 moves off ramp 83 and onto inner rail 85, sear 33 has rotated enough so that sear face 47 disengages from lug face 77. As shown in FIG. 9, this rotated position of sear 33 allows striker 57 to move forward, and striker 57 does so at a high velocity due to the force of compressed striker spring 58.

After strikers 57 have moved forward, the user releases trigger assembly 15, and sears 33 move forward, lug 59 causing the rear of sears 33 to rotate inward as they pass lugs 59. Sears 33 then reset in front of lugs 59, and this allows the user to pull trigger assembly 15 rearward again for immediate restrike capability in case of a failure to fire one or more primers. The independent configuration of sears 33 and strikers 57 allows operation of at least one striker 57 when other strikers 57 are inoperable.

To prevent unintended rearward movement of trigger assembly 15, an external manual safety 87 is shown installed on trigger assembly 15. Safety 87 comprises an upper slider 89 and a lower slider 91, sliders 89, 91 connected to each other by post 93 extending through transverse slot 95. Upper slider 89 has a tab 97 extending laterally and sized for engaging a notch 99 formed in aperture 21 of housing 13. Safety 87 is selectively movable relative to trigger assembly 15 between a "safe" position (as shown in FIG. 1), in which tab 97 is located within notch 99 for preventing rearward movement of trigger assembly 15, and a "fire" position, in which tab 97 is moved from within notch 99, allowing rearward movement of trigger assembly 15. Though shown as having a sliding safety 87, device 11 may alternatively comprise another type of safety, such as a cross-bolt or pivoting safety.

As mentioned above, the internal volume of the enclosure of device 11 is preferably waterproof or at least resistant to water or dust entering the volume. To increase the likelihood of continued operation of device 11 if dust or water has entered the volume, cover plate 17 is shown with optional dust grooves 101 formed thereon, providing a space for sand, dust, dirt, debris, or water to collect away from the operating parts of device 11. Likewise, one or more voids 103 are preferably formed in trigger assembly 15 to provide additional space for dust or water to collect. Voids 103 also reduce the mass of trigger assembly 15, allowing trigger to return forward more quickly when released after firing.

Figure 6:
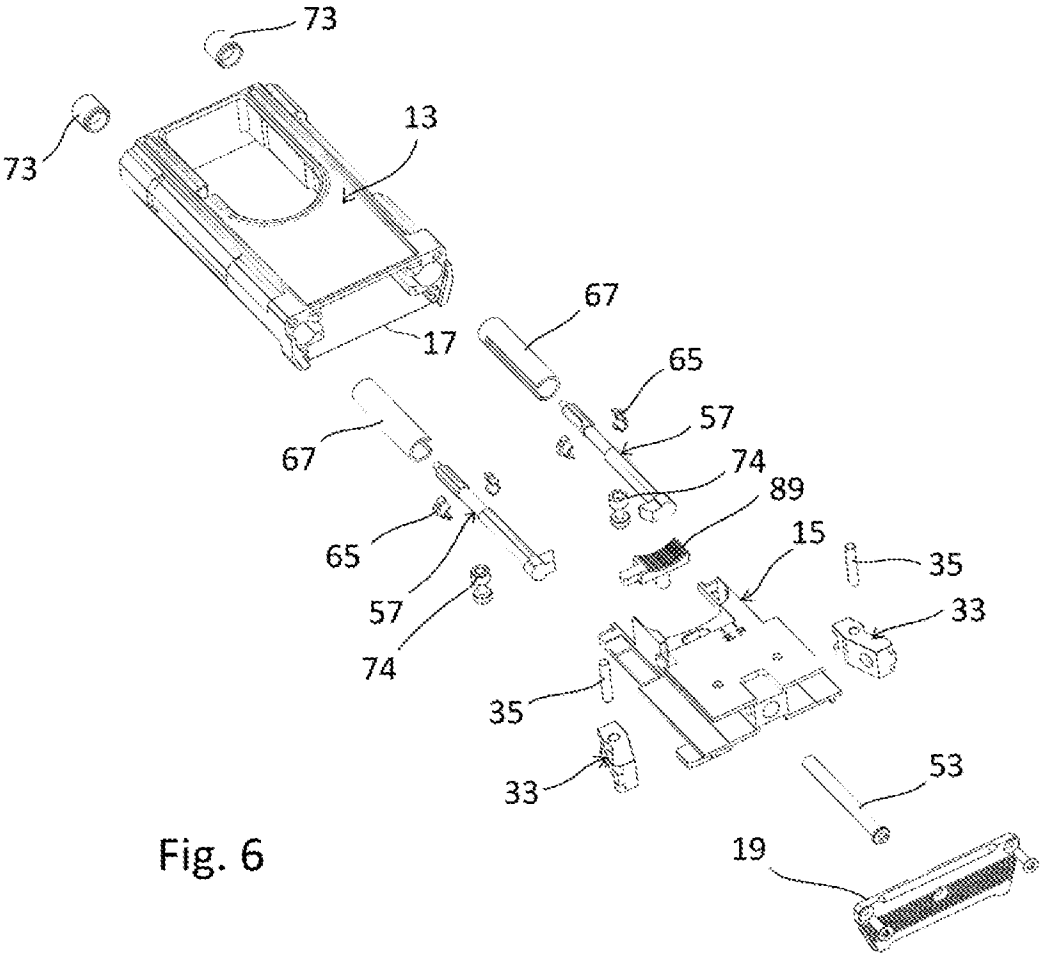
FIG. 6 is an oblique exploded view of the firing device of FIG. 1.

The configuration of device 11 enables a user to easily disassemble device 11 for maintenance or repair. In the embodiment shown, a user can remove rear plate 19, allowing removal of the internal components from the rear of device 11, as shown in FIG. 6.

Figure 10:
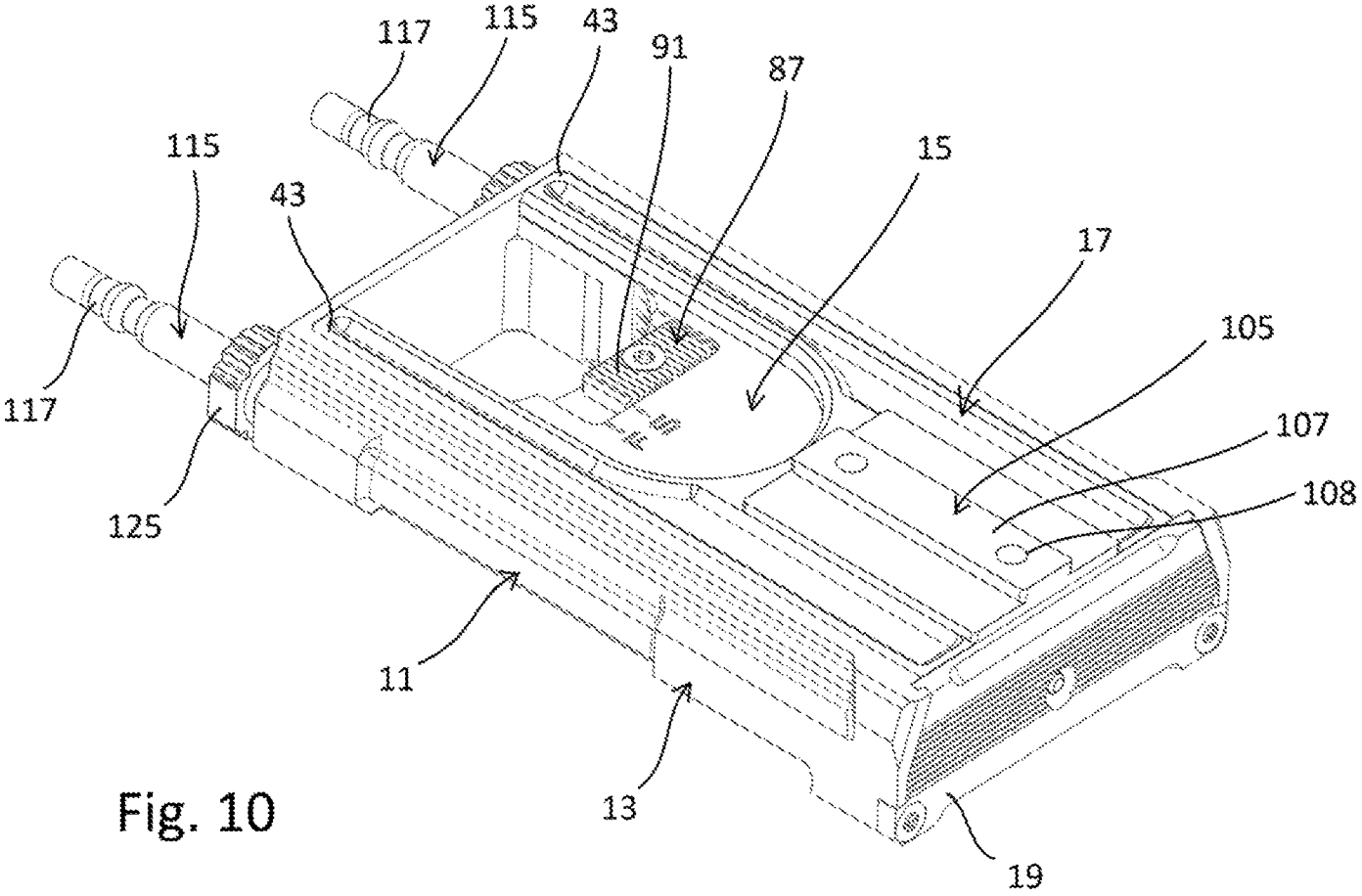
FIG. 10 is an oblique view of the bottom of the firing device of FIG. 1.

Referring to FIG. 10, the bottom portion of cover plate 17 may be formed to have an optional integral or removable mount 105 or similar feature that can be used to attach accessories or attach device 11 to another object. Mount 105 may have an integral feature, such as boss 107, and optional fastener holes 108 for attaching various optional accessories or mounting adapters, such as low profile, pocket clip, Picatinny, and pole-mount adapters.

Figure 11:
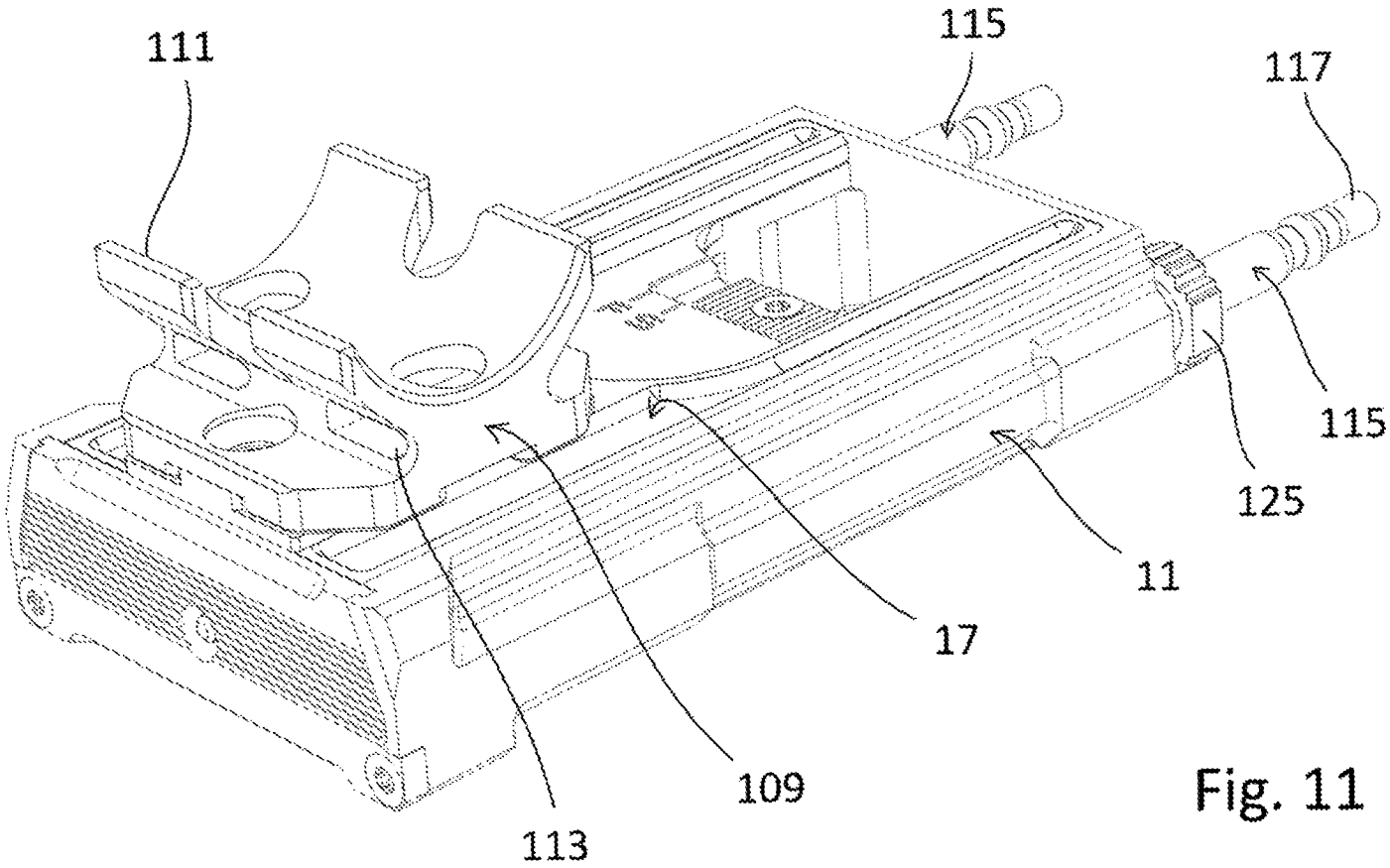
FIG. 11 is an oblique view of the bottom of the firing device of FIG. 1 with a mounting adapter installed.

For example, FIG. 11 shows a pole-mount adapter 109 attached to boss 107, adapter 109 having a curved portion 111 sized and shaped for receiving the outer surface of a cylindrical pole. Slots 113 are formed in adapter 109 to allow for adapter 109 to be affixed to a pole with straps passing through slots 113 and around the pole. Alternatively, cover plate 17 may be an interchangeable panel of various configurations, including configurations with integral accessories or adapters. Boss 107 is preferably configured for use with quick-detach (QD) types of accessories, such as those having a QD lever or similar QD feature.

Additionally, two devices 11 may be assembled together using optional features on cover plate 17, such as male/female dovetails, and both devices 11 can optionally be fired simultaneously with use of a transfer bar (not shown) or similar component connecting trigger assemblies 15 of devices 11. Also, a shock-tube cutter may be installed or formed on device 11.

Figure 12:
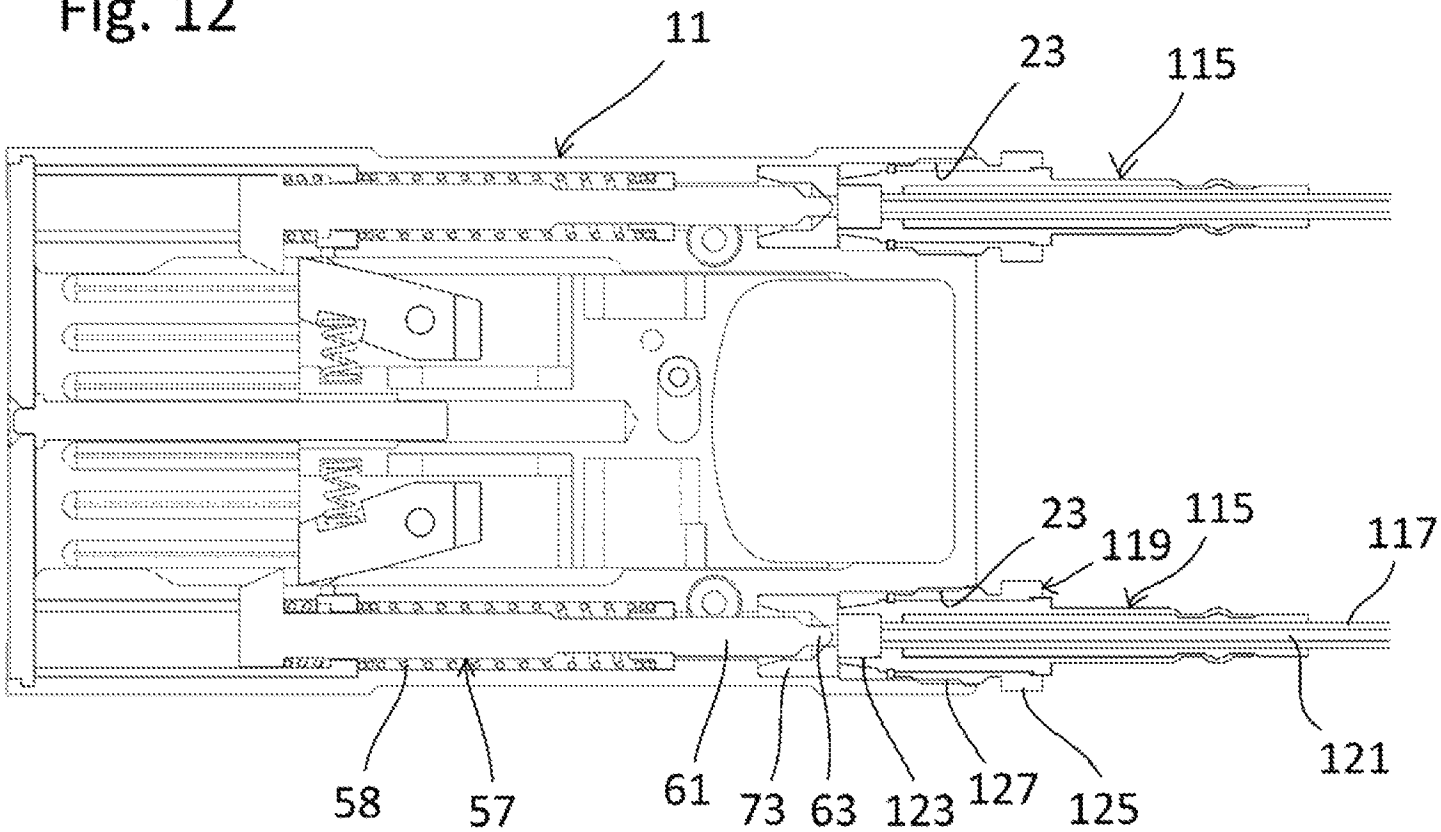
FIG. 12 is a cross-section top view of the firing device of FIG. 1 along a horizontal plane, shock-tube inserts being shown installed on the firing device.

FIGS. 10 through 12 show device 11 with shock-tube direct-fire inserts 115 installed in bores 23, FIG. 12 being a cross-section top view. Inserts 115 comprise a shock tube 117 and a threaded collar 119 for engaging threads 24 (FIG. 4) in bore 23. Shock tube 117 has a central bore 121 that extends rearward and is in fluid communication with a primer pocket 123 formed at the rear of insert 115. A knob 125 allows a user to easily rotate collar 119 during installation as threads 127 engage threads 24 of bore 23.

Inserts 115 are provided with a primer (not shown) installed in primer pocket 123, and insert 115 is installed by threading collar 119 into bore 23 until the rear end of insert 115 contacts the forward end of tip guide 73. This places the rear of primer pocket 123 adjacent guide 73 and in a position to allow striker tip 63 to strike and ignite a primer when striker 57 is released from a rearward position and is propelled forward by striker spring 58. The ignition products of the ignited primer travel forward through bore 121 for initiating detonation within shock tube 117.

FIGS. 13 through 19 illustrate alternative embodiments of a firing device according to this disclosure.

Figure 13:
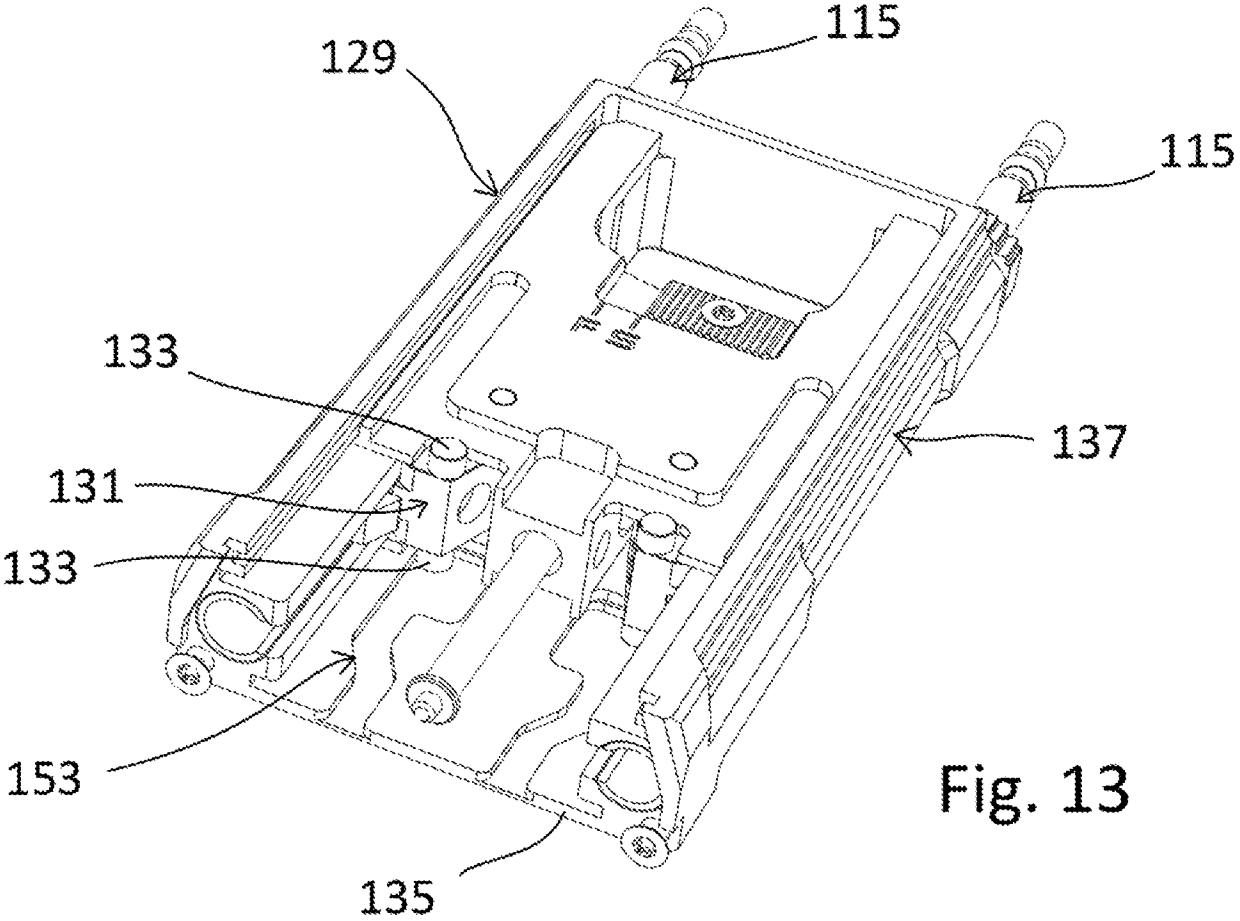
FIG. 13 is an oblique view of an alternative embodiment of a firing device according to this disclosure, the device shown with a component removed for ease of viewing.
Figure 14:
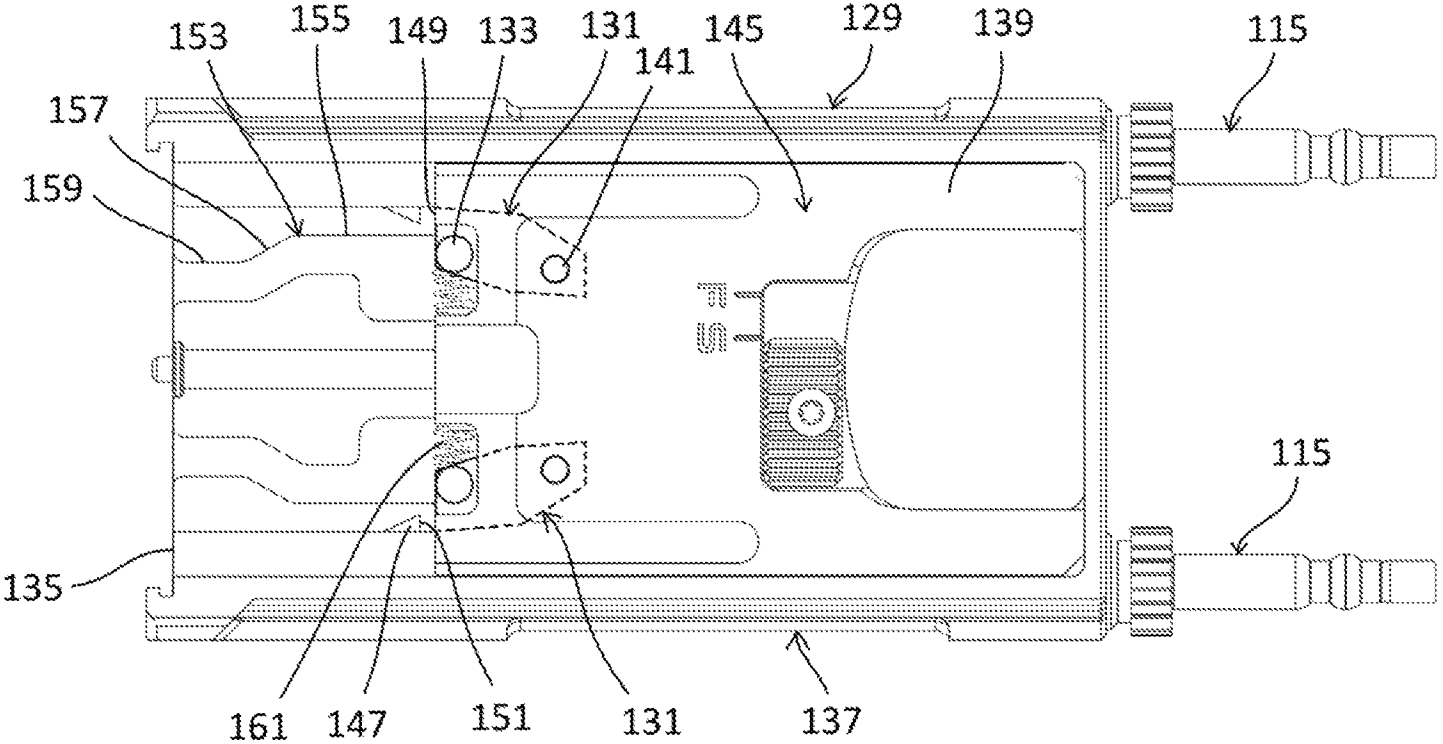
FIG. 14 is a bottom view of the firing device of FIG. 13, the device shown with a component removed for ease of viewing.

FIGS. 13 and 14 show a firing device 129, which has a similar configuration to device 11, as described above. However, rather than having a cam profile that acts on cam surfaces of each sear, sears 131 of device 129 have posts 133 that slide within slots formed in an upper plate 135 of housing 137.

Sears 131 are pivotally carried by trigger 139, each sear 131 pivoting on a vertical pin 141. As trigger assembly 145 is moved rearward, each sear 131 engages lug 147 of the corresponding striker. Sear face 149 contacts lug face 151 for causing the striker to move rearward with trigger assembly 145. To release the striker during this rearward motion after the striker spring is sufficiently compressed, an S-shaped slot 153 is formed on upper plate 135 for guiding lower posts 133 and causing rotation of sears 131. Each slot 153 comprises an enlarged forward section 155, an angled central section 157, and a rear section 159 offset from forward sections 155. A spring 161 biases the rear portion of each sear 131 toward the corresponding striker. Though shown with slots 153 formed in upper plate 135 of housing 137, slots may alternatively be formed in a cover plate (not shown) that cooperates with housing 137 to form an enclosure.

As trigger assembly 145 moves rearward, sear face 149 presses against lug face 151, forcing the striker rearward. Spring 161 forces lower post 133 against the outer edge of enlarged section 155 of slot 153, and posts 133 pass from section 155 to angled section 157. Posts 133 are captured within angled section 157, which causes sear 131 to rotate about pin 141 as section 157 forces posts 133 inward. This rotation of sear 131 begins to move sear face 149 inward, and as posts 133 move from angled section 157 to straight section 159, sear 131 has rotated enough so that sear face 149 disengages from lug face 151. This rotated position of sear 131 allows the striker to move forward at a high velocity due to the force of the compressed striker spring.

After the strikers have moved forward, the user releases trigger assembly 145. As sears 131 move forward, angled section 157 guides posts 133 outward, causing sear 131 to rotate back to the original position. Enlarged section 155 allows room for posts 133 to move inward as lug 147 causes sear 131 to rotate as it passes lug 147. Sears 131 then reset in front of lugs 147, and this allows the user to pull trigger assembly 145 rearward again for immediate restrike capability in case of a failure to fire one or more primers. One aspect to this embodiment is that posts 133 are captured by section 157 of each slot 153, which completely controls rotation of each sear 131. As with device 11 above, the independent configuration of sears 131 and the strikers allows operation of at least one striker, even when the other striker is inoperable.

Figure 15:
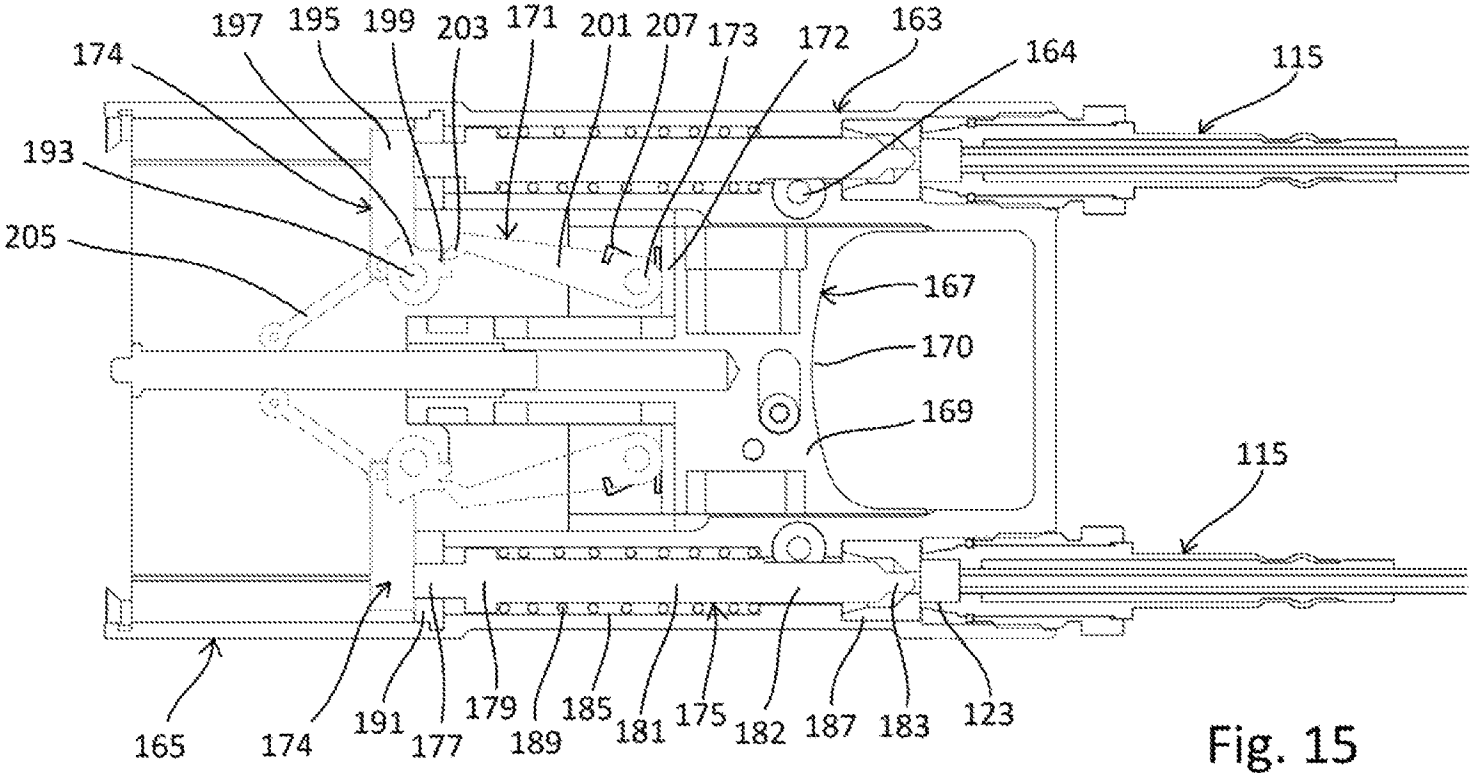
FIG. 15 is a cross-section bottom view of another alternative embodiment of a firing device according to this disclosure, the cross-section taken along a horizontal plane.

FIG. 15 illustrates a firing device 163, which has a generally similar configuration to device 11, as described above. However, rather than having strikers that move rearward during movement of a trigger assembly, device 163 has independent rotating hammers that strike the rear end of primer ignition devices, referred to as firing pins in this configuration, to drive them forward for igniting primers. As in device 11 above, firing pin blocks 164 are actuated during movement of the trigger to allow the firing pins to move forward enough for a forward portion to strike a primer in primer pocket 123 of shock-tube direct-fire insert 115.

Device 163 comprises a housing 165 and a trigger assembly 167 carried within and longitudinally movable relative to housing 165. Trigger assembly 167 comprises trigger 169, which is generally configured similarly to trigger assembly 15 of device 11, and assembly 167 is biased forward toward a neutral position shown in the figure. Assembly 167 comprises an actuation portion 170, and elongated sears 171 are pivotally connected to a carrier portion 172 of trigger 169 by vertical pins 173. Unlike devices 11 and 129, in which strikers are moved rearward to compress a striker spring, in device 163 each sear 171 is used to rotate a corresponding hammer 174 for hitting a firing pin 175, propelling it forward so that the tip of pin 175 extends into primer pocket 123 of installed shock-tube insert 115. Each pin 175 is preferably a rigid, one-piece component comprising a rear end 177, a flange 179, a central section 181, a block engagement section 182, and a tip 183. Each pin 175 is carried within a bore 185 formed in housing 165, and the forward tip 183 of each pin 175 is located in a cylindrical tip guide 187. A pin spring 189 biases the corresponding pin 175 rearward and extends between a forward end of bore 185 and flange 179.

When hammer 174 is rotated away from firing pin 175, spring 189 causes pin 175 to move rearward until flange 179 contacts a rear cap 191 of bore 185. Rear end 177 of pin 175 then extends past the rear surface of cap 191. When hammer 174 falls and hits rear end 177 of pin 175, pin 175 is propelled forward with enough momentum to overcome the rearward biasing force of spring 189. Pin 175 continues forward far enough that tip 183 extends into primer pocket 123 for striking and igniting a primer contained therein, and then spring 189 returns firing pin 175 to the original position, wherein tip 183 is recessed from primer pocket 123. As in device 11, firing pin blocks 164 cooperate with engagement portion 182 of each pin 175 to prevent forward movement of pin 175 until blocks 164 have been moved upward by actuators (not shown) on trigger assembly 167.

Each hammer 174 is pivotally connected to housing 165 by a pin 193, allowing hammers 174 to rotate about pin 193 relative to housing 165. Each hammer 174 comprises a plate 195 and an integral shaft 197 with a notch 199 for engaging the corresponding sear 171. Each sear 171 comprises an arm 201 terminating in a hand 203 configured to engage notch 199 of hammer 174. A hammer mainspring 205 biases hammer 174 toward the forward rotational position shown in FIG. 15, and a torsion spring 207 (partially visible) rotationally biases each sear 171 inward.

To fire device 163, trigger assembly 167 is moved rearward, which causes hand 203 of each sear 171 to press against notch 199 for the corresponding hammer 174. This causes hammers 174 to rotate rearward relative to housing 165 about pins 193, and this allows firing pins 175 to move rearward, such that rear end 177 protrudes from cap 191. Hammer mainspring 205 is compressed as hammer 174 is rotated rearward, increasing the biasing force. The angle of notch 199 relative to hand 203 changes as hammer 174 rotates, and hand 203 will slip from notch 199, allowing hammer 174 to be forcefully rotated forward by compressed mainspring 205. Plate 195 hits rear end 177 of pin 175, propelling pin 175 forward, with tip 183 entering primer pocket 123 to ignite a primer. As hammer 174 rotates forward, the rear portion of sear 171 moves outward of shaft 197. As the user allows trigger assembly 167 to return to the neutral position, hand 203 of sear 171 slides against shaft 197 and then resets when hand 203 is realigned with notch 199, allowing for trigger assembly 167 to again rotate hammers 174 when assembly 167 is moved rearward. This configuration allows for immediate restrike capability in case one or more primers do not ignite.

Though not shown, in an alternative version of device 163 each hammer 174 includes a post on at least one side of hammer 174 that serves the same function as that of notch 199. Hand 203 of each sear 171 is configured to engage the post, allowing sear 171 to rotate the associated hammer 174 rearward as trigger assembly 167 is moved rearward.

Figure 16:
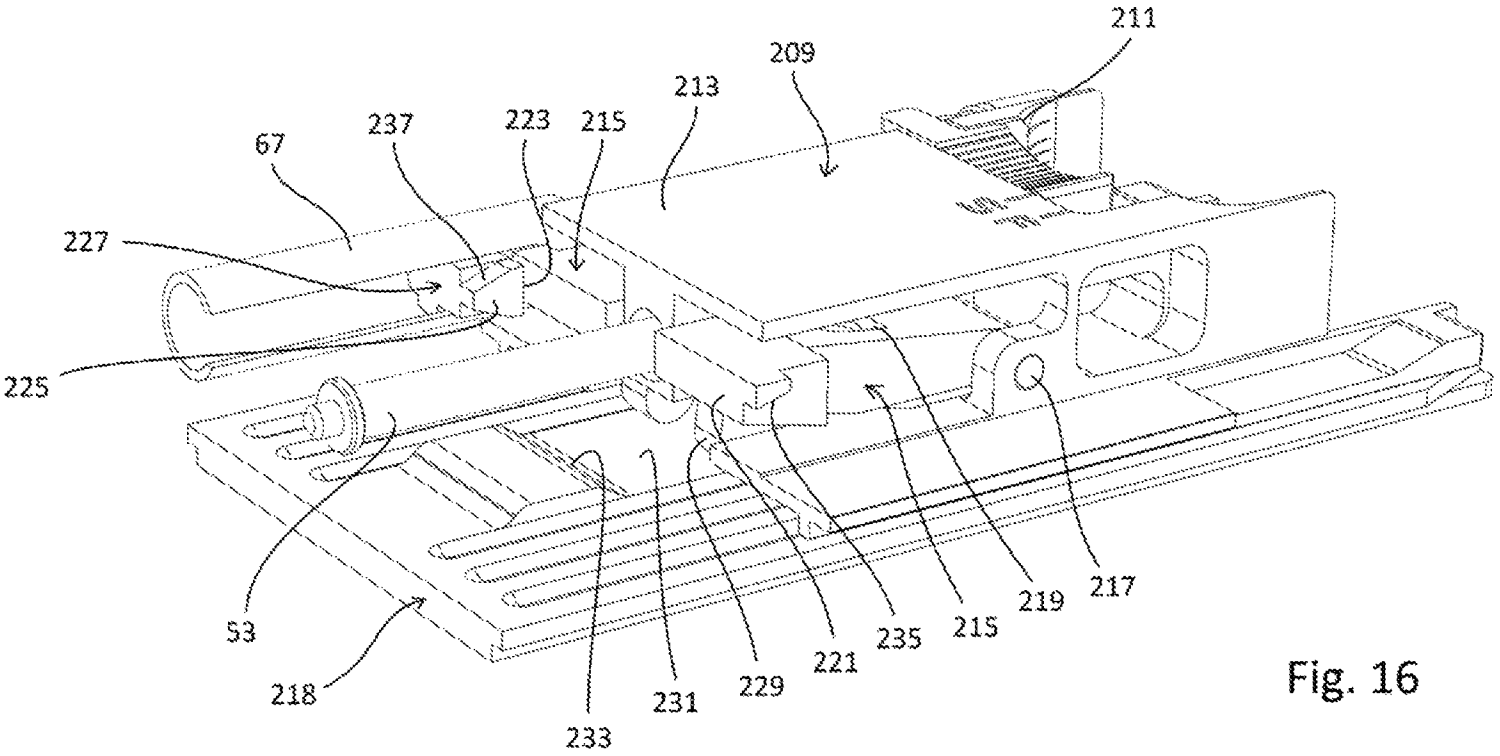
FIG. 16 is an oblique view of another alternative embodiment of a firing device according to this disclosure.
Figure 17:
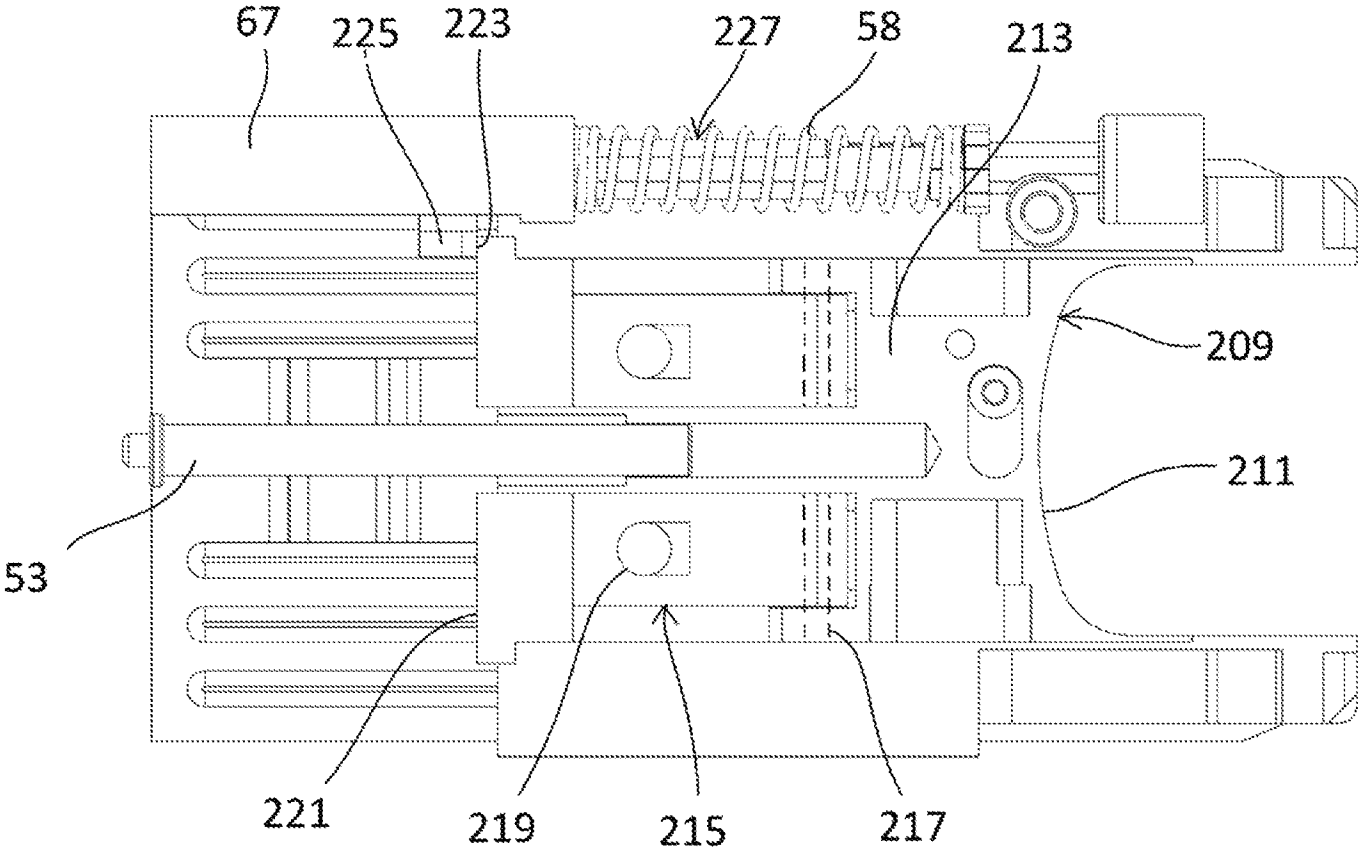
FIG. 17 is a top view of the firing device of FIG. 16, the device shown with components removed for ease of viewing.

FIGS. 16 and 17 illustrate components of another embodiment of a firing device according to this disclosure and configured similarly to device 11, as described above. Trigger assembly 209, which is configured similarly to trigger assembly 15, as described above, comprises forward actuation portion 211 and rearward carrier portion 213, and these may be formed as a unitary component or as separate components joined together. Carrier portion 213 carries two sears 215, but sears 215 rotate about axes oriented 90 degrees from those of sears 33 of device 11. Each sear 215 rotates about a horizontal pin 217, which is located at a forward portion of sear 215, and this allows the rear portion of each sear 215 to rotate toward and away from cover plate 218. A spring (not shown) engages spring pocket 219 for biasing sear 215 toward cover plate 218. Each sear 215 comprises a rear-facing sear face 221 for engaging a forward-facing lug face 223 on lug 225 of striker 227, which is carried by sleeve 67 and biased forward by striker spring 58. A cam lug 229 depends from sear 215 on the opposite side of sear 215 as spring pocket 219. Trigger assembly 209 is biased forward by trigger spring assembly 53.

As trigger assembly 209 is moved rearward, sear face 221 of each sear 215 engages lug face 223 of the corresponding striker 227 and forces striker 227 rearward, compressing spring 58. Sear 215 moves rearward as part of trigger assembly 209, and cam lug 229 slides rearward along inner surface 231 of cover plate 218. A ramp 233 is formed on or affixed to surface 231 at a rearward central position, and each cam lug 229 rides up and over ramp 233, forcing the rear of each sear 215 upward enough to move sear face 221 from engagement with lug face 223. This motion releases strikers 227 to move forward due to the force of compressed springs 58. When the user allows trigger assembly 209 to move forward after release of strikers 227, a reset face 235 on sear 215 slides up and over an angled face 237 on lug 225 of corresponding striker 227, thereby resetting sears 215 forward of lugs 225. Though shown with ramp 233 being located on cover plate 218 for forcing sears 215 away from plate 218, trigger assembly 209 may alternatively be configured with sears 215 inverted and configured to engage a ramp located on the housing (not shown).

Figure 18:
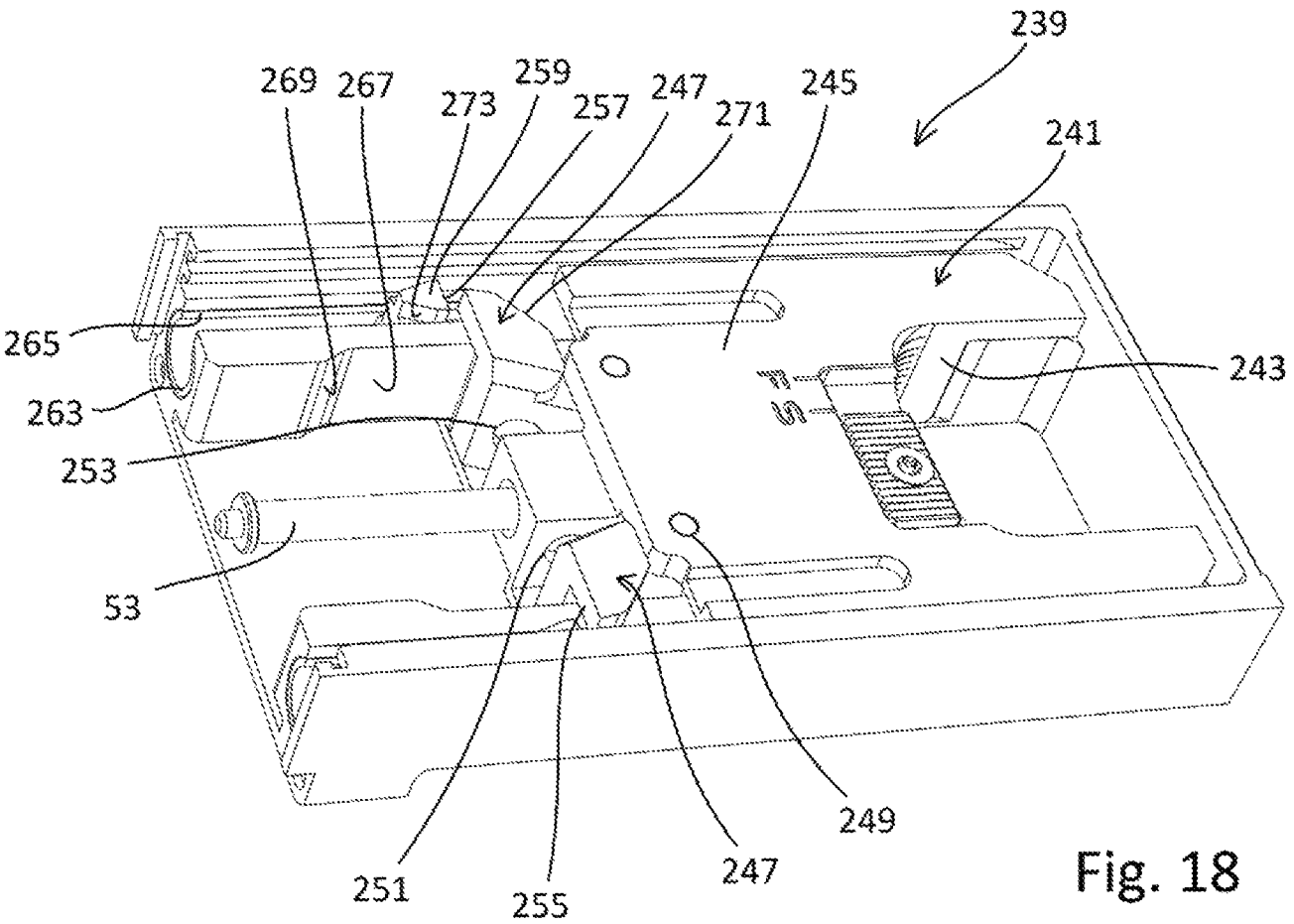
FIG. 18 is an oblique view of another alternative embodiment of a firing device according to this disclosure, the device shown with components removed for ease of viewing.
Figure 19:
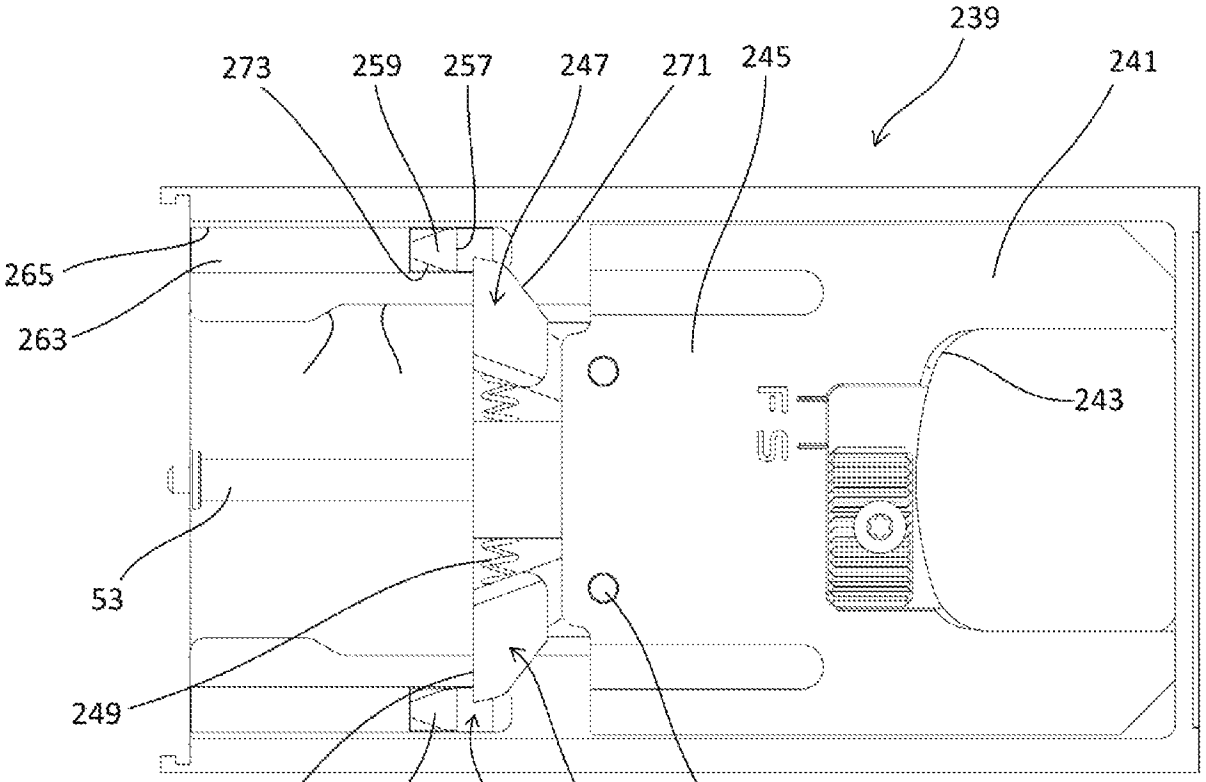
FIG. 19 is a top view of the firing device of FIG. 18, the device shown with components removed for ease of viewing.

FIGS. 18 and 19 illustrate another embodiment of a firing device 239 according to this disclosure and configured similarly to device 11, as described above. Trigger assembly 241, which is configured similarly to trigger assembly 15, as described above, comprises forward actuation portion 243 and rearward carrier portion 245, and these may be formed as a unitary component or as separate components joined together. Carrier portion 245 carries two sears 247, and each sear 247 rotates about a vertical pin 249 located at a central portion of sear 247. Spring 249 engages spring pockets 251, 253 for biasing sear 247 outward. Each sear 247 comprises a rear-facing sear face 255 for engaging a forward-facing lug face 257 on lug 259 of each striker 261. Each striker 261 is carried by sleeve 263, which has an upper slot 265 for the associated lug 259 to translate within. Each striker 261 is biased forward by a striker spring (not shown), and trigger assembly 241 is biased forward by trigger spring assembly 53.

As trigger assembly 241 is moved rearward, sear face 255 of each sear 247 engages lug face 257 of the corresponding striker 261 for forcing striker 261 rearward and compressing the striker spring. Sears 247 move rearward as part of trigger assembly 241, and an outer edge of each sear 247 slides along an associated vertical inner surface 267. A ramp 269 is formed on or affixed to surface 267 at a rearward position, and each sear 247 rides up and over ramp 269, forcing the rear of each sear 247 inward enough to move sear face 255 from engagement with lug face 257. This motion releases strikers 261 to move forward due to the force of the compressed striker springs. When the user allows trigger assembly 241 to move forward after release of strikers 261, a reset face 271 on sear 247 slides up and over an angled face 273 on lug 259 of the corresponding striker 261, thereby resetting sears 247 forward of lugs 259.

While shown as having a translatable trigger for moving the carrier portion rearward, it should be noted that other types of actuation portions may be used for other embodiments of the firing device, such as, for example, rotary triggers or pivoting triggers. To allow for a compact firing device, it is preferred that any trigger be located within the volume defined by the outer surfaces of the device enclosure, as shown in the embodiments herein, and not protrude during operation.

The firing device of this disclosure provides several significant advantages, including having independently operated strikers, immediate restrike capability, safety, reliability, durability, modularity, ease of use, ease of field maintenance, fixed headspacing, and excellent resistance to penetration of dirt and water from the outside environment.

This disclosure includes illustrative embodiments having a limited number of forms, which are amenable to various changes and modifications without departing from the spirit thereof.

What is claimed is:

1. A shock-tube firing device, comprising:

an enclosure;

at least two primer-ignition devices translatably carried within the enclosure and biased toward a neutral position;

a threaded bore for each primer-ignition device, each bore being adjacent a forward end of an associated primer-ignition device and configured to receive a threaded shock-tube adapter;

a trigger assembly carried by the enclosure, the trigger assembly being biased toward a neutral position and comprising an actuation portion and a carrier portion, the actuation portion being configured to cause rearward motion of the carrier portion when the actuation portion is moved from the neutral position;

a biasing element for each primer-ignition device, each biasing element configured to cause forward motion of the associated primer-ignition device; and a sear for each primer-ignition device, each sear being carried by the carrier portion and configured to cause compression of an associated biasing element;

wherein movement of the actuation portion causes rearward motion of the carrier portion and the sears, thereby compressing the biasing elements for causing forward motion of the primer-ignition devices.

2. The firing device of claim 1, wherein the actuation portion is a translatable trigger, a rotary trigger, or a pivoting trigger.

3. The firing device of claim 2, wherein the trigger is located between the primer-ignition devices.

4. The firing device of claim 2, wherein substantially all of the trigger is located between outer surfaces of the enclosure.

5. The firing device of claim 2, further comprising:

an aperture in the enclosure for accessing the trigger.

6. The firing device of claim 2, further comprising:

an aperture in the enclosure for accessing the trigger, wherein the trigger may be operated from opposite sides of the enclosure.

7. The firing device of claim 1, wherein each primer-ignition device is a spring-biased striker.

8. The firing device of claim 1, wherein each primer ignition device is a firing pin propelled by a spring-biased hammer.

9. A shock-tube firing device, comprising:

an enclosure;

at least two strikers translatably carried within the enclosure;

a threaded bore for each primer-ignition device, each bore being adjacent a forward end of an associated primer-ignition device and configured to receive a threaded shock-tube adapter;

a trigger assembly carried by the enclosure, the trigger assembly being biased toward a neutral position and comprising an actuation portion and a carrier portion, the actuation portion being configured to cause rearward motion of the carrier portion when the actuation portion is moved from the neutral position;

a spring for each striker, each spring configured to bias an associated striker in a forward direction;

a sear for releasably engaging each striker, each sear being carried by the carrier portion and configured to cause rearward motion of the associated striker during rearward motion of the carrier portion;

wherein movement of the actuation portion causes rearward motion of the carrier portion and the sears, thereby compressing the springs and then releasing the strikers to allow forward motion of the strikers.

10. The firing device of claim 9, wherein the actuation portion is a translatable trigger, a rotary trigger, or a pivoting trigger.

11. The firing device of claim 10, wherein the trigger is located between the strikers.

12. The firing device of claim 10, wherein substantially all of the trigger is located between outer surfaces of the enclosure.

13. The firing device of claim 10, further comprising:

an aperture in the enclosure for accessing the trigger.

14. The firing device of claim 10, further comprising:

an aperture in the enclosure for accessing the trigger, wherein the trigger may be operated from opposite sides of the enclosure.

15. A shock-tube firing device, comprising:

an enclosure;

at least two firing pins translatably carried within the enclosure;

a trigger assembly carried by the enclosure, the trigger assembly being biased toward a neutral position and comprising an actuation portion and a carrier portion, the actuation portion being configured to cause rearward motion of the carrier portion when the actuation portion is moved from the neutral position;

a hammer for each firing pin, each hammer being biased in a forward direction and configured to strike an associated firing pin for causing forward motion of the firing pin;

a sear for releasably engaging each hammer, each sear being carried by the carrier portion and configured to cause rearward motion of an associated hammer during rearward motion of the carrier portion;

wherein movement of the actuation portion causes rearward motion of the carrier portion and the sears, thereby moving the hammers rearward and then releasing the hammers to cause forward motion of the firing pins.

16. The firing device of claim 15, wherein the actuation portion is a translatable trigger, a rotary trigger, or a pivoting trigger.

17. The firing device of claim 16, wherein the trigger is located between the firing pins.

18. The firing device of claim 16, wherein substantially all of the trigger is located between outer surfaces of the enclosure.

19. The firing device of claim 16, further comprising:

an aperture in the enclosure for accessing the trigger.

20. The firing device of claim 16, further comprising:

an aperture in the enclosure for accessing the trigger, wherein the trigger may be operated from opposite sides of the enclosure.

* * * * *